United States Patent [19]

Shimba et al.

[11] 4,450,228

[45] May 22, 1984

[54] LIGHT-SENSITIVE SILVER HALIDE COLOR PHOTOGRAPHIC MATERIAL

[75] Inventors: Satoru Shimba; Kenji Ito; Yasuo Tsuda; Hiroshi Sugita, all of Hino, Japan

[73] Assignee: Konishiroku Photo Industry Co., Ltd., Tokyo, Japan

[21] Appl. No.: 468,400

[22] Filed: Feb. 22, 1983

[30] Foreign Application Priority Data

Feb. 25, 1982 [JP] Japan ..... 57-30391

[51] Int. Cl.[3] ..... G03C 1/46

[52] U.S. Cl. ..... 430/505; 430/552; 430/553; 430/558

[58] Field of Search ..... 430/505, 552, 553, 567, 430/558

[56] References Cited

U.S. PATENT DOCUMENTS

| | | | |
|---|---|---|---|
| 3,446,622 | 5/1969 | Magagnoli et al. | 430/376 |
| 3,758,308 | 9/1973 | Beavers et al. | 430/553 |
| 3,880,661 | 4/1975 | Lau et al. | 430/553 |
| 4,228,233 | 10/1980 | Yagihara et al. | 430/553 |
| 4,250,251 | 2/1981 | Osborn et al. | 430/505 |
| 4,333,999 | 6/1982 | Lau | 430/552 |

*Primary Examiner*—J. Travis Brown

*Attorney, Agent, or Firm*—Frishauf, Holtz, Goodman & Woodward

[57] ABSTRACT

Disclosed is a light-silver silver halide color photographic material, having a blue sensitive silver halide emulsion layer, a green sensitive silver halide emulsion and a red sensitive silver halide emulsion on a support; which comprises said red sensitive silver halide emulsion containing at least one kind of the compounds represented by the formula [I] shown below, and further the content of the silver halide contained in all of the aforesaid light-sensitive silver halide emulsion layers being 7.5 g/m$^2$ or more as calculated on silver, and the content of the silver halide contained in said red sensitive silver halide emulsion being 3.5 g/m$^2$ or more as calculated on silver:

Formula [I]

wherein, X, $R_1$ and $R_2$ as defined in the specification.

10 Claims, No Drawings

LIGHT-SENSITIVE SILVER HALIDE COLOR PHOTOGRAPHIC MATERIAL

This invention relates to a light-sensitive silver halide color photographic material (hereinafter referred to as color sensitive material). Color sensitive materials generally comprise a red sensitive silver halide emulsion layer containing a cyan color forming coupler, a green sensitive silver halide emulsion containing a magenta color forming coupler, a yellow filter layer which can be made substantially colorless during photographic processings and a blue sensitive silver halide emulsion layer containing a yellow color forming coupler consecutively provided on a support. In addition to these photographic layers, they may frequently have a halation preventive layer, an intermediate layer and a protective layer.

In the light-sensitive silver halide materials at the present time, still higher sensitivity and image quality are desirable. In order to obtain a high sensitivity, much efforts have been made as to the method for formation of silver halide grains, silver halide compositions, chemical sensitization, spectral sensitization, etc. However, even when all of these methods for elevation of sensitivity so far known in the art may be used, the results obtained in the resultant color sensitive material are not yet satisfactory. As another effective method for enhancement of sensitivity in light-sensitive silver halide materials, there may be mentioned increase of the size of silver halide grains. However, according to this method, image quality, particularly graininess and sharpness are lowered as the enhancement of sensitivity. The graininess of the color image finally obtained in a color sensitive material is influenced not only by the graininess of the silver image but also by the developing agent coupler and the co-existing substances. As the method for improvement of image quality, particularly graininess and sharpness of a color sensitive material, there may effectively be employed the method in which an increased amount of silver is used, the method in which a coupler of the type releasing a development inhibitor (conventionally called as a DIR coupler) or a compound capable of releasing a development inhibitor, although it is not a coupler, is employed; and further the method in which each of blue sensitive, green sensitive and red sensitive layers is constituted of two or more layers with different mean sizes of silver halide grains. However, a color sensitive material having blue sensitive, green sensitive and red sensitive layers formed by employment of such methods has encountered, in addition to the problem of image quality, particularly graininess and sharpness, a new problem not found in color sensitive materials of the prior art with sensitivities which are not relatively high. That is, there is involved the problem that silver removal at the time of bleaching processing is worsened to a great extent due to the measures adopted for the purpose of obtaining a highly sensitized high image quality such as increase of mean size of silver halide grains, increase of the amount of silver coated, increased film thickness as the result of constituting one light-sensitive layer of two or more layers and use of a DIR coupler or a DIR compound.

In particular, in the color sensitive materials as described above, silver removal during bleaching processing from the red sensitive silver halide emulsion located nearest to the support side is a considerably greater problem as compared with that from the green sensitive layer and the blue sensitive layer.

That is, as is well known to those skilled in the art, poor silver removal is vital in color reproduction of the sensitive material obtained after processing, and minute amount of residual silver after processing is said to be harmful in storability of color images. Thus, poor silver removal during bleaching processing makes it almost impossible to provide a practically suitable color sensitive material.

An object of this invention is to provide a color sensitive mterial having blue sensitive, green sensitive and red sensitive layers, comprising a silver halide contained in all the light-sensitive silver halide emulsion layers in an amount of 7.5 g/m$^2$ or more as calculated on silver and a silver halide contained in the aforesaid red sensitive layer in an amount of 3.5 g/m$^2$ or more as calculated on silver, which is improved in silver removal from respective original color sensitive materials. More specifically, an object of this invention is to provide a light-sensitive silver halide color photographic material improved in silver removal characteristic in the red sensitive layer (group) as mentioned above.

Another object of this invention is to provide a high sensitivity, high image quality light-sensitive silver halide color photographic material excellent in processing stability, particularly adaptability for bleaching processing.

The objects of this invention have been accomplished by a light-sensitive silver halide color photographic material, having a blue sensitive silver halide emulsion layer, a green sensitive silver halide emulsion and a red sensitive silver halide emulsion on a support, said red sensitive silver halide emulsion containing at least one kind of the compounds represented by the formula [I] shown below, and further the content of the silver halide contained in all of the aforesaid light-sensitive silver halide emulsion layers being 7.5 g/m$^2$ or more as calculated on silver, and the content of the silver halide contained in said red sensitive silver halide emulsion being 3.5 g/m$^2$ or more as calculated on silver.

Formula [I]

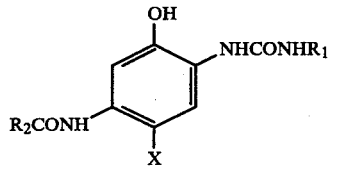

wherein, X represents a hydrogen atom or an eliminable group through coupling with an oxidized product of an aromatic primary amine color developing agent; $R_1$ represents a naphthyl group or a heterocyclic group (provided that a carbon atom of a heterocyclic group is bonded to the nitrogen atoms of the ureido group), or a phenyl group having at least one substituent (with proviso that, when having a cyano at the p-position relative to the ureido group, the four positions of o-position and m-position relative to the ureido group cannot have hudrogen atoms at the same time) selected from the group consisting of a trifluoromethyl, nitro, a cyano, $$-COR,\ -COOR,\ -SO_2R,\ -SO_2OR,\ -CON\begin{matrix}R\\R'\end{matrix},$$

-continued

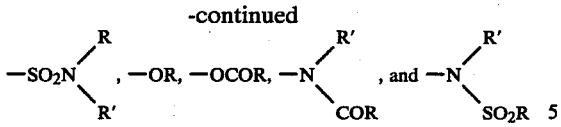

(where R represents an aliphatic group or an aromatic group, and R′ represents a hydrogen atom, an aliphatic group or an aromatic group); and $R_2$ represents an aliphatic group or an aromatic group necessary to impart diffusion resistance to the cyan dyes formed from the cyan couplers represented by the formula [I] and the cyan dyes to be formed from said cyan coupler.

Preferable cyan couplers according to the formula [I] of this invention are represented typically by the following formula [Ia] or [Ib]:

Formula [Ia]

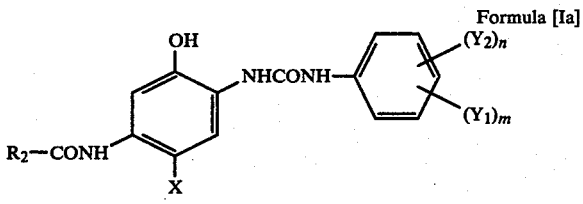

Formula [Ib]

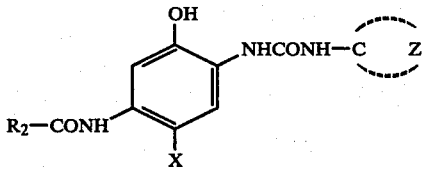

In the above formula [Ia], $Y_1$ represents a trifluoromethyl, a nitro, a cyano or a group represented by —COR, —COOR, $—SO_2R$, $—SO_2OR$,

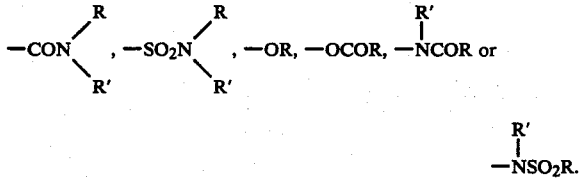

R represents an aliphatic group [preferably an alkyl group having 1 to 10 carbon atoms (e.g. methyl, butyl, cyclohexyl, benzyl)] or an aromatic group [preferably a phenyl group (e.g. phenyl or tolyl)], and R′ represents a hydrogen atom or a group represented by R.

$Y_2$ represents a monovalent group, preferably an aliphatic group [preferably an alkyl group having 1 to 10 carbon atoms (e.g. methyl, t-butyl, ethoxyethyl, cyanomethyl)], an aromatic group [preferably a phenyl group, a naphthyl group (e.g. phenyl, tolyl)], a halogen atom (fluorine, chlorine, bromine or the like), an amino group (e.g. ethylamino, diethylamino), a hydroxy or a substituent represented by $Y_1$.

m is an integer of 1 to 3, and n is an integer of 0 to 3, with proviso that m+n should be 5 or less, and, when a cyano group is bonded at the p-position of the ureido group, m+n should be within the range from 2 to 5.

Z represents a group of non-metallic atoms necessary for forming a heterocyclic group or a naphthyl group, and as a heterocyclic group, a five-membered or six-membered heterocyclic group containing 1 to 4 hetero atoms selected from nitrogen atoms, oxygen atoms or sulfur atoms. For example, there may be included a furyl group, a thienyl group, a pyridyl group, a quinonyl group, an oxazolyl group, a tetrazolyl group, a benzothiazolyl group, a tetrahydrofuranyl group and the like. These rings may have any desired substituents incorporated therein, including, for example, alkyl groups having 1 to 10 carbon atoms (e.g. ethyl, i-propyl, i-butyl, t-butyl, t-octyl, and the like), aryl groups (e.g. phenyl, naphthyl), halogen atoms (e.g. fluorine, chlorine, bromine and the like), cyano, nitro, sulfonamide groups (e.g. methanesulfonamide, butanesulfonamide, p-toluenesulfonamide and the like), sulfamoyl groups (e.g. methylsulfamoyl, phenylsulfamoyl and the like), sulfonyl groups (e.g. methanesulfonyl, p-toluenesulfonly and the like), fluorosulfonyl groups, carbamoyl groups (e.g. dimethylcarbamoyl, phenyl-carbamoyl and the like), oxycarbonyl groups (e.g. ethoxycarbonyl, phenoxycarbonyl and the like), acyl groups (e.g. acetyl, benzoyl and the like), heterocyclic groups (e.g. pyridyl group, pyrazolyl group and the like), alkoxy groups, aryloxy groups, acyloxy groups, and so on.

$R_2$ represents an aliphatic group or an aromatic group necessary for imparting diffusion resistance to a cyan coupler represented by the above formula [I] or a cyan dye to be formed from said cyan coupler, preferably an alkyl group having 4 to 30 carbon atoms, an aryl group or a heterocyclic group. For example, there may be included a straight or branched alkyl group (e.g. t-butyl, n-octyl, t-octyl, n-dodecyl and the like), an alkenyl group, a cycloalkyl group, a five-membered or six-membered heterocyclic group or a group represented by the formula [Ic]:

Formula [Ic]

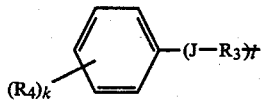

In the above formula, J represents an oxygen atom or a sulfur atom; K represents an integer of 0 to 4; l represents an integer of 0 or 1; when K is 2 or more, two or more existing $R_4$'s may be the same or different; $R_3$ represents a straight or branched alkyl having 1 to 20 carbon atoms; and $R_4$ represents a monovalent atom or group, including, for example, a hydrogen atom, a halogen atom (preferably chloro, bromo), an alkyl group {preferably a straight or branched alkyl group having 1 to 20 carbon atoms (e.g. methyl, tert-butyl, tert-pentyl, tert-octyl, dodecyl, pentadecyl, benzyl, phenetyl)}, an aryl group (e.g. phenyl), a heterocyclic group (preferably a nitrogen containing heterocyclic group), an alkoxy group {preferably a straight or branched alkyloxy group (e.g. mehoxy, ethoxy, tert-butyloxy, octyloxy, decyloxy, dodecyloxy)}, an aryloxy group (e.g. phenoxy), a hydroxy group, an acyloxy group {preferably an alkylcarbonyloxy group, an arylcarbonyloxy group (e.g. acetoxy, benzoyloxy)}, a carboxy group, an alkoxycarbonyl group (preferably a straight or branched alkyloxycarbonyl group having 1 to 20 carbon atoms), an aryloxycarbonyl group (preferably phenoxycarbonyl), an alkylthio group (preferably having 1 to 20 carbon atoms), an acyl group (preferably a straight or branched alkylcarbonyl group having 1 to 20 carbon atoms), an acylamino group (preferably a straight or branched alkylcarboamide, benzenecarboamide having 1 to 20 carbon atoms), a sulfonamide group (preferably a straight or branched alkylsulfonamide group having 1 to 20 carbon atoms, benzenesulfonamide group), a carbamoyl group (preferably a straight or branched alkylaminocarbonyl group having 1 to 20 carbon atoms, phenylaminocarbonyl group), a sulfamoyl group (preferably an alkylaminosulfonyl group having 1 to 20 carbon atoms, phenylaminosulfonyl group) and so on. X represents a hydrogen atom or an eliminable group during coupling reaction with an oxidized product of a color developing agent. For example, there may be included halogen atoms (e.g. chlorine, bromine, fluorine or the like), aryloxy groups, carbamoyloxy groups, carbamoylmethoxy groups, acyloxy groups, sulfonamide groups, succinimide groups and the like, of which oxygen atom or nitrogen atoms is bonded directly to the coupling position. More specifically, there may be mentioned those as disclosed in U.S. Pat. No. 3,741,563, Japanese Provisional Patent Publication No. 37425/1972, Japanese Patent Publication No. 36894/1973, Japanese aprovisional Patent Publication Nos. 10135/1975, 117422/1975, 130441/1975, 108841/1975, 120334/1975, 18315/1977 and 105226/1978.

The cyan coupler according to this invenition can readily be synthesized by use of the methods as described in, for example, U.S. Pat. No. 3,758,308 and Japanese Provisional Patent Publication No. 65134/1981.

Preferable compounds of the cyan coupler of the formula [I] are exemplified below.

(1)

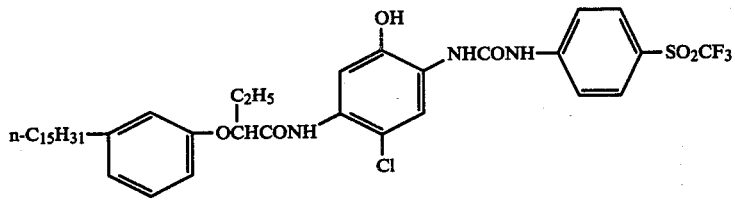

(2)

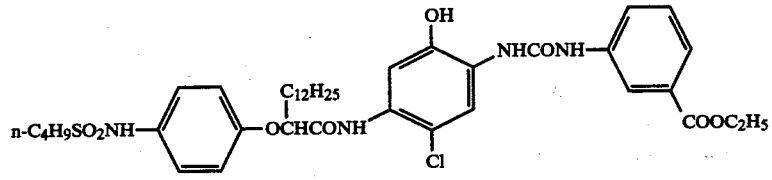

(3)

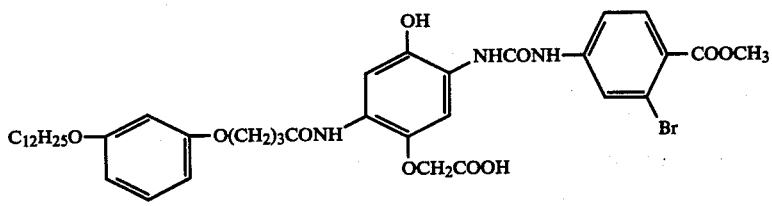

(4)

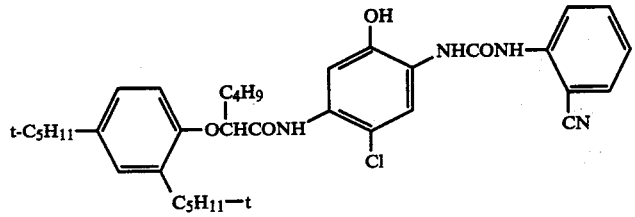

(5)

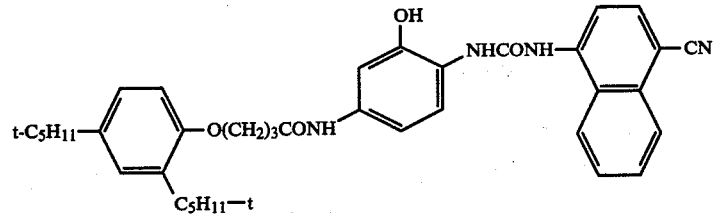

(6)

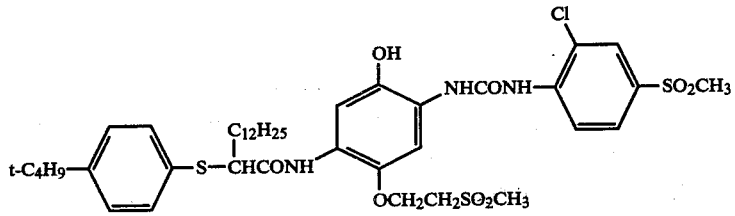

-continued
(7)
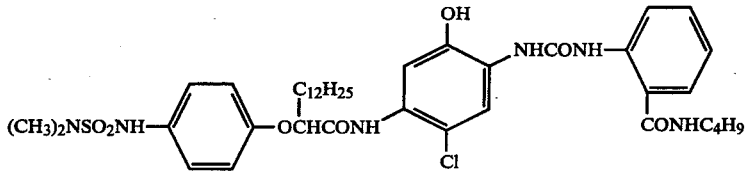
(8)
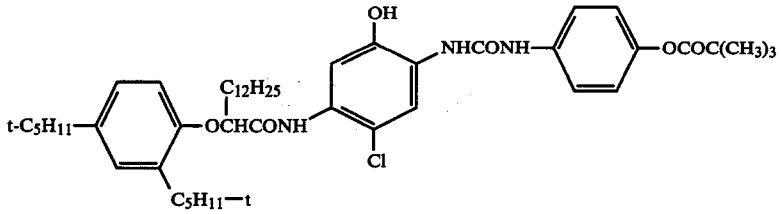
(9)
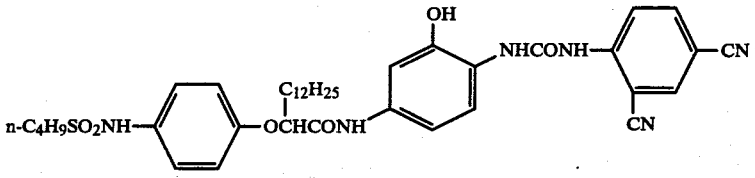
(10)
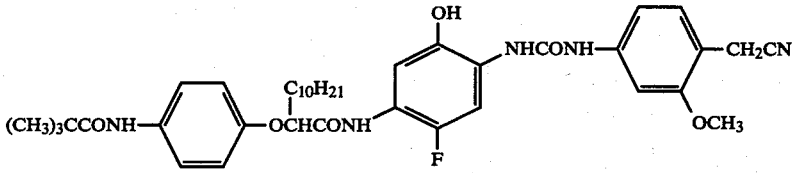
(11)
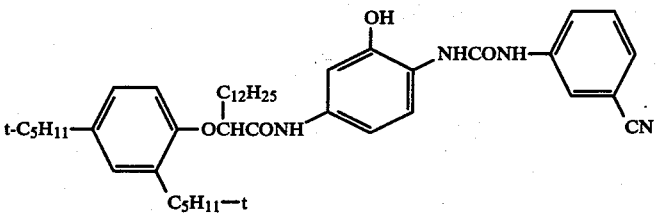
(12)
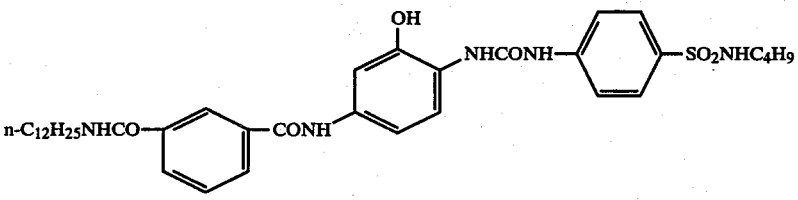
(13)
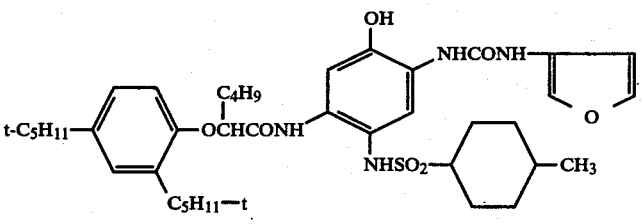
(14)
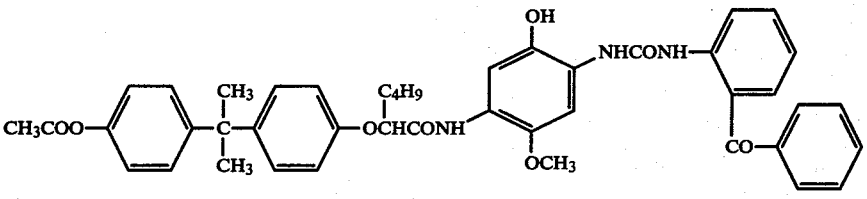

-continued
(15)
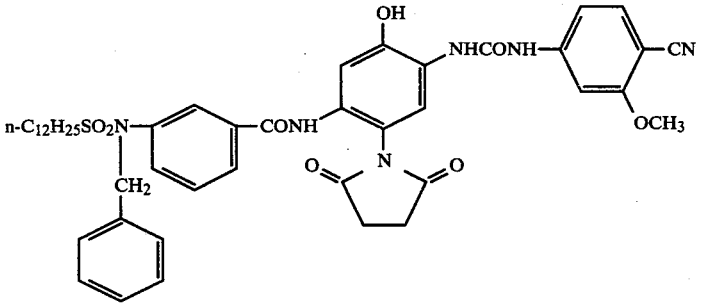
(16)
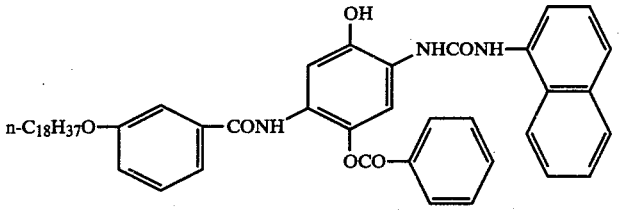
(17)
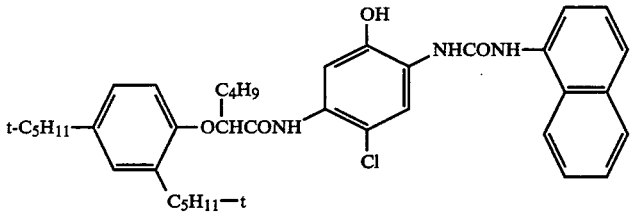
(18)
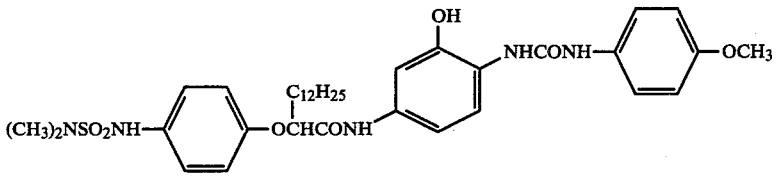
(19)
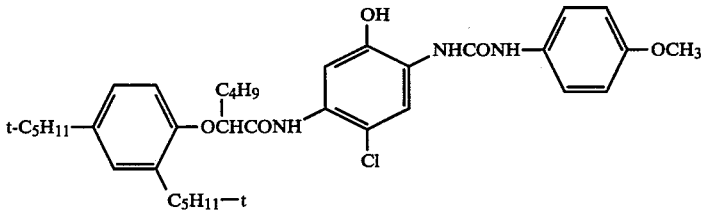
(20)
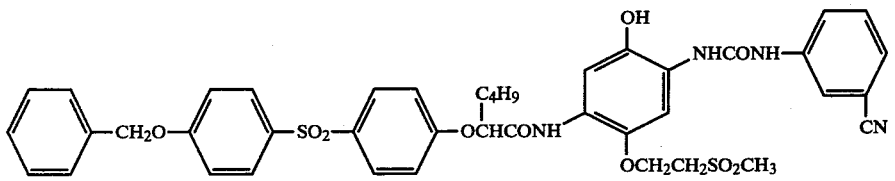

-continued
(21)
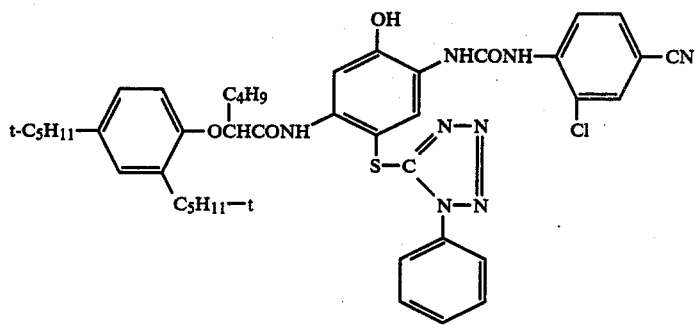
(22)
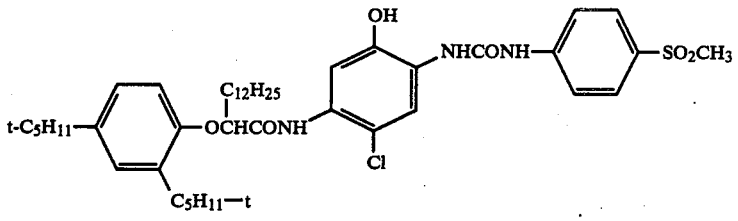
(23)
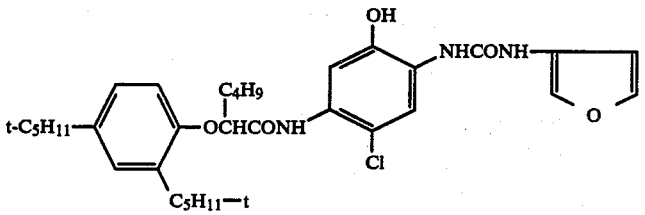
(24)
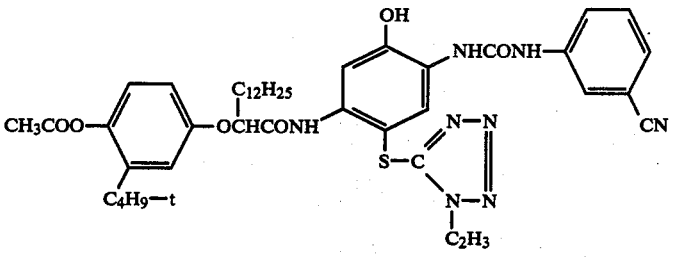
(25)
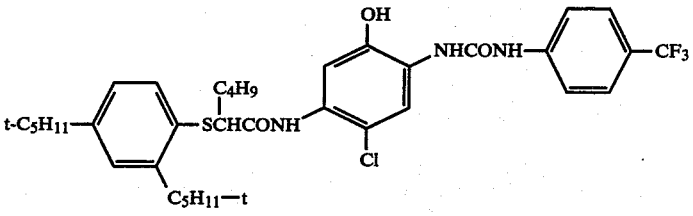
(26)
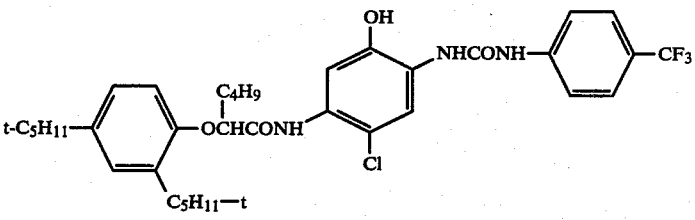

-continued
(27)
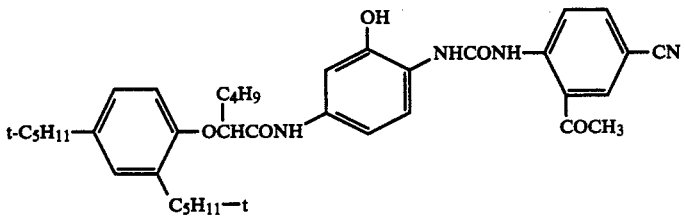
(28)
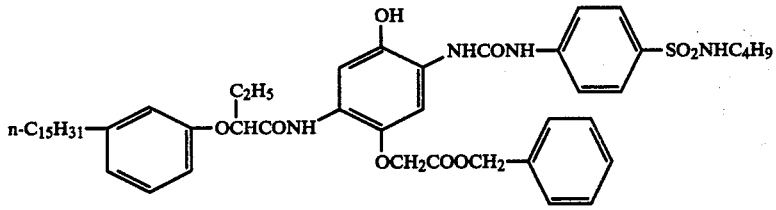
(29)
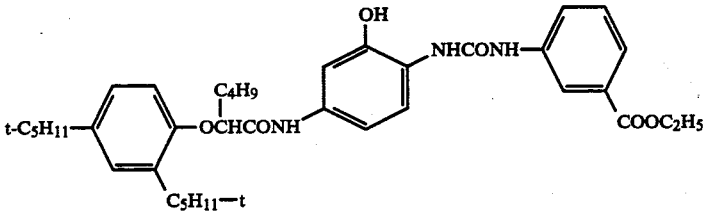
(30)
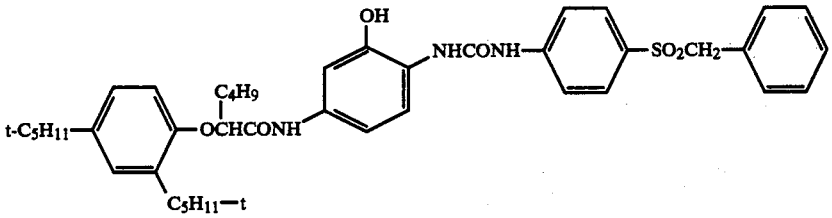
(31)
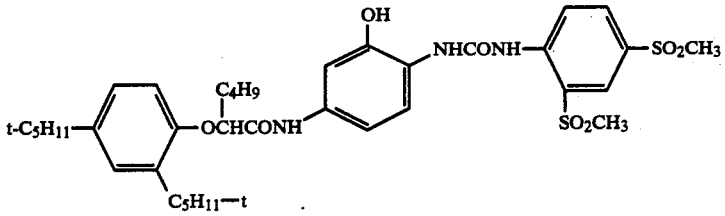
(32)
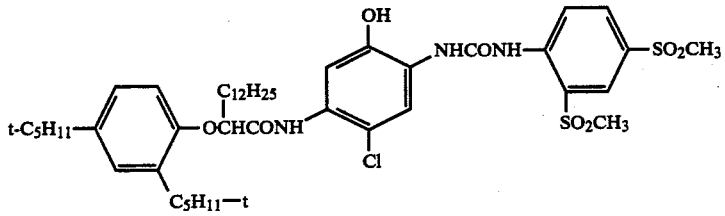
(33)
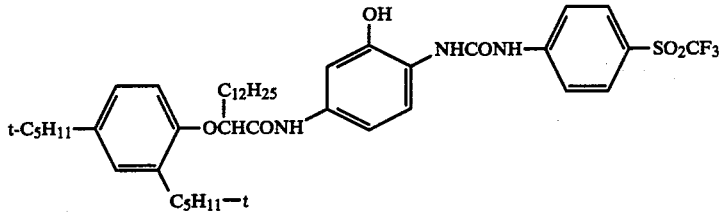

-continued
(34)
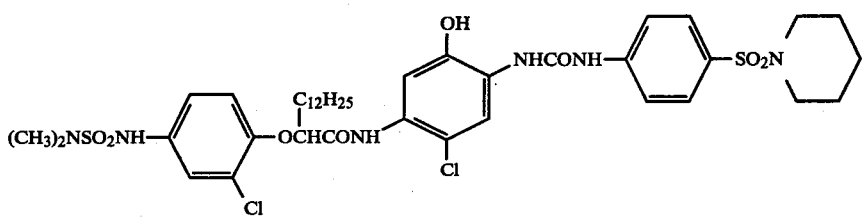
(35)
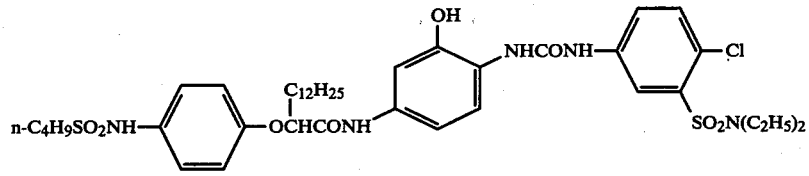
(36)
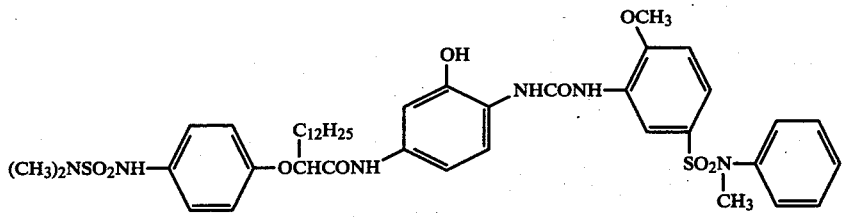
(37)
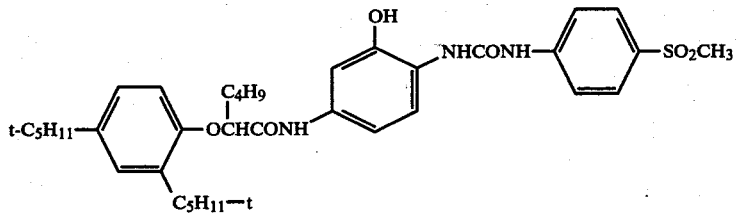
(38)
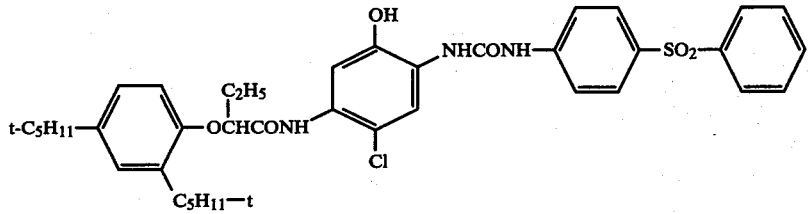
(39)
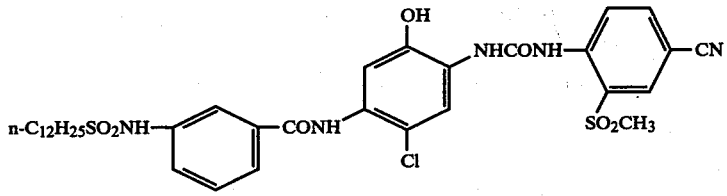
(40)
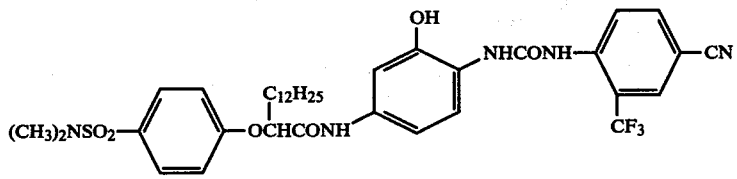

-continued (41)

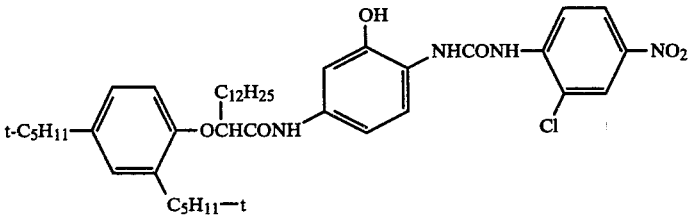

(42)

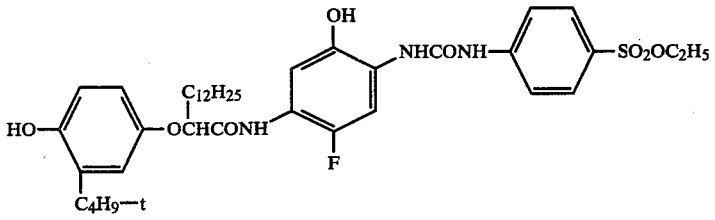

(43)

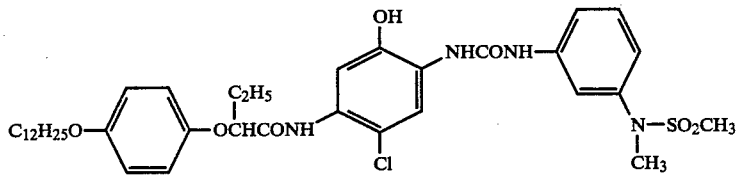

(44)

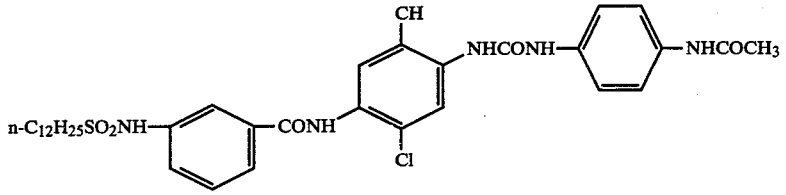

(45)

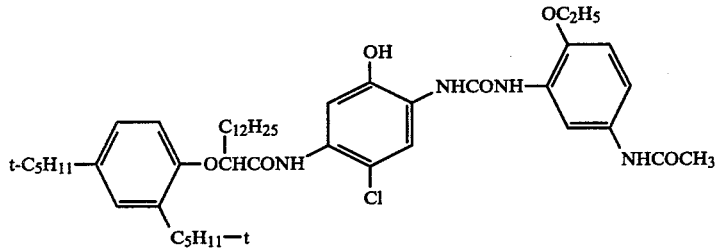

(46)

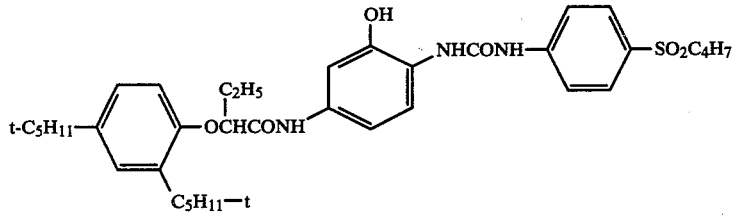

As other preferable compounds, there may also be employed those as disclosed in, for example, Japanese Laid-open Patent Applications Nos. 204543/1982, 204544/1982 and 204545/1982, and Japanese Patent Applications Nos. 131312/1981, 131313/1981, and 131314/1981.

In the color sensitive material of this invention, the red sensitive layer may comprise either two silver halide emulsion layers as in U.K. Pat. No. 923045, three silver halide emulsion layers as in U.S. Pat. No. 3,843,369 or four or more silver halide emulsion layers. Ths silver content in the group of red sensitive layers in the sensitive material of this invention must be 3.5 g/m$^2$ or higher. A content of 4.5 g/m$^2$ or more is more preferable. Also, the total silver halide content in the blue sensitive, green sensitive and red sensitive emulsion layers must be 7.5 g/m$^2$ or more as calculated on silver, preferably 8.5 g/m$^2$ or more.

In this invention, the upper limit of the silver halide content in all the light-sensitive silver halide emulsion layers depends on the kind of the light-sensitive material and cannot be defined equally, but it is approximately 15 g/m$^2$, while the upper limit of the silver halide content in the red sensitive silver halide emulsion layer is approximately 10 g/m$^2$.

Also, the proportion of the silver halide content in the red sensitive silver halide emulsion may be 40 to 80%, more preferably, 40 to 70% of the total silver halide content in all the light-sensitive silver halide emulsions.

In the color sensitive material of this invention, the green sensitive layer and the blue sensitive layer may also comprise two or more emulsion layers with different sensitivities and/or mean grain sizes. It is preferred that at least one of the red sensitive, green sensitive and blue sensitive layers should comprise emulsion layers with different sensitivities. The relation with respect to sensitivity, mean grain diameter between plural emulsion layers in each color sensitive layer group may be cosen adequately, whereby the advantages as disclosed in U.S. Pat. No. 3,843,369 and Japanese Provisional Patent Publication No. 44022/1978, and such a choice is easy to those skilled in the art.

A color sensitive material having blue sensitive, green sensitive and red sensitive layers, comprising a silver halide contained in all the light-sensitive silver halide emulsion layers in an amount of 7.5 g/m$^2$ or more as calculated on silver and a silver halide contained in the aforesaid red sensitive layer in an amount of 3.5 g/m$^2$ or more as calculated on silver, and the advantages brought about by such a material are known as disclosed in Japanese Provisional Patent Publication No. 44022/1978 and others. The light-sensitive material of this invention has of course the advantages of such a light-sensitive material, but the technical task which must be overcome by this invention has been very difficult to be solved only by the means as disclosed in said patent specification.

In the light-sensitive color material of this invention, the silver content in the blue sensitive layer may suitably be 1.5 to 3.0 g/m$^2$ as calculated on silver, while that in the green sensitive layer 2.5 to 5.0 g/m$^2$. These do not differ greatly from those conventionally used in the known color sensitive materials. Therefore, the total silver halide content in blue sensitive layer and green sensitive layer in the color sensitive material of this invention may suitably be 4.0 to 8.0 g/m$^2$.

In the photographic emulsion of a light-sensitive photographic material prepared by use of this invention may also contain dye forming couplers other than those employed in this invention, nemely compounds capable of forming dyes with an oxidized product of an aromatic amine (usually a primary amine) developing agent. These couplers may desirably be non-diffusive type, containing a hydrophobic group called as a ballast group in the molecule. The couplers may be either tetraequivalent or diequivalent to silver ion.

As yellow couplers, there may be employed open-chain keto-methylene type couplers well known in the art. Among them, benzoylacetanilide type and pivaloyl acetanilide type compounds are advantageous. Useful yellow color forming couplers may be exemplified by those disclosed in U.S. Pat. Nos. 2,875,057; 3,265,506; 3,408,194; 3,551,135; 3,582,322; 3,725,072; 3,891,445; West German Pat. No. 1,547,868; West German Offenlegungsschirift Nos. 2,219,917; 2,261,361; and 2,414,006; U.K. Pat. No. 1,425,020; Japanese Patent Publication No. 10783/1976; Japanese Provisional Patent Publication Nos. 26133/1972, 73147/1972, 102636/1976, 6341/1975, 123342/1975, 130442/1975, 21827/1976, 87650/1975, 82424/1977 and 115219/1977.

As magenta color forming couplers, there may be employed pyrazolone type compound, indazolone type compounds, cyanoacetyl compounds. In particular, pyrazolone type compounds are advantageous. Useful magent color forming couplers may include those as disclosed in U.S. Pat. Nos. 2,600,788; 2,983,608; 3.026653; 3.127,269; 3.311,476; 3,419.391; 3,519,429; 3,558,319; 3,582,322; 3,615,506; 3,834,908; 3,891,445; West German Pat. No. 1,810,464; West German Patent Application (OLS) Nos. 2,408,665, 2,417,945, 2,418,959 and 4,24,467; Japanese Patent Publication No. 6031/1965; Japanese Provisional Patent Publication Nos. 20826/1976, 58922/1977, 129538/1974, 74027/1974, 159336/1975, 42121/1977, 74028/1974, 60233/1975, 26541/1976 and 55122/1978.

As cyan color forming couplers, there may be employed phenol type compounds and naphthol type compounds. Typical examples may include those as disclosed in U.S. Pat. Nos. 2,369,929; 2,434,272; 2,474,293; 2,521,908; 2,895,826; 3,034,892; 3,311,476; 3,458,315; 3,476,563; 3,583,971; 3,591,383, 3,767,411; 4,004,929; West German Patent Application (OLS) Nos. 2,424,803 and 2,454,329; Japanese Provisional Patent Publication Nos. 59838/1973, 26034/1976, 69624/1977 and 90932/1977.

Two or more kinds of the above couplers may be contained in the same layer. The same compound may also be contained in two or more layers. These couplers may be added generally in amounts of $2\times10^{-3}$ mol to $5\times10^{-1}$ mol, preferably $1\times10^{-2}$ mol to $5\times10^{-1}$ mol per mol of silver in the emulsion layer.

The above couplers may be introduced into a silver halide emulsion layer accordng to a known method, such as the method as disclosed in U.S. Pat. No. 2,322,027. For example, after being dissolved in an alkyl phthalate (e.g. dibutyl phthalate, dioctyl phthalate, etc.), a phosphate (e.g. diphenyl phosphate, triphenyl phosphate, tricresyl phosphate, dioctyl phosphate, dioctylbutyl phosphate, etc.), a citrate (e.g. tributyl acetylcitrate), a benzoate (e.g. octyl benzoate), an alkylamide (e.g. diethyllaurylamide), an aliphatic acid ester (e.g. dibutoxyethylsuccinate, dioctylazelate), or an organic solvent having a boiling point of about 30° C. to 150° C., including for example a lower alkyl acetate such as ethyl acetate or butyl acetate, ethyl propionate, sec-butyl alcohol, methyl isobutyl ketone, $\beta$-ethoxyethyl acetate, methyl cellosolve acetate and so on, the resultant solution is dispersed in a hydrophilic colloid. Mixtures of the above high boiling organic solvent with a low boiling organic solvent may also be available.

There may also be employed the dispersing method with the use of a polymer as disclosed in Japanese Patent Publication No. 39853/1976 and Japanese Provisional Patent Publication No. 59943/1976. When the coupler has an acid group such as a carboxylic group or a sulfonic acid group, it may be introduced into a hydrophilic colloid as an alkaline aqueous solution.

In the light-sensitive material prepared by use of this invention, a UV-ray absorber may be contained in the hydrophilic colloid. For example, there may be employed benzotriazole compounds substituted with aryl group (e.g. those disclosed in U.S. Pat. No. 3,533,794), 4-thiazolidone compounds (e.g. those disclosed in U.S. Pat. No. 3,314,794), benzophenone compounds (e.g. those as disclosed in Japanese Provisional Patent Publication No. 2784/1971), cinnamic acid ester compounds (those as disclosed in U.S. Pat. Nos. 3,705,805 and 3,707,375), butadiene compounds (e.g. those as disclosed in 4,045,229), or benzooxyzoles (e.g. those as disclosed in 3,700,455). Further, it is also possible to use the compounds as disclosed in U.S. Pat. No. 3,499,762 and Japanese Provisional Patent Publication No. 48535/1979. UV-ray absorbing couplers (e.g. α-naphthol type cyan dye forming couplers) or UV-ray absorbable polymers may also be available. These UV-ray absorbers may be mordanted in a specific layer.

In the light-sensitive silver halide color photographic material, for which this invention is applied, as the hydrophilic colloid to be advanageously used for preparation of the silver halide emulsion and the hydrophilic colloid to be used in non-light-sensitive hydrophilic colloid layer, there may be included gelatin; gelatin derivatives such as phenycarbamylated gelatin, amylted gelatin, phthalated gelatin and the like; colloidal albumin; agar; gum arabic; cellulose derivatives such as hydrolyzed cellulose acetate, carboxymethyl cellulose, hydroxyethyl cellulose, methyl cellulose and the like; acrylamide; imidated polyacrylamide; casein; vinyl alcohol polymers containing urethanecarboxylic acid group or cyanoacetyl group such as vinyl alcohol-vinylcyano acetate copolymer; polyvinyl alcohol; polyvinyl pyrrolidone; hydrolyzed polyvinyl acetate; and polymers obtained by polymerization of a protein or a saturated acylated protein with a monomer having a vinyl group. As the silver halide to be used in the silver halide emulsion, there may be included any one conventionally used in silver halide photographic emulsions such as silver bromide, silver chloride, silver iodobromide, silver chlorobromide, silver chloroiodobromide and the like.

The silver halide grains in these materials may be either coarse grains or fine grains, and the distribution of the grain sizes may be either narrow or broad. The crystals of these silver halide grains may be either normal or twin crystals, and the crystals with any desired ratio of [1.0.0.] plane to [1.1.1.] plane may be available. These silver halide grains may have a crystalline structure which is uniform from the inner portion to the outer portion, or a layered structure with different inner and outer layers. Further, these silver halides may be either of the type forming latent images on its surface or of the type forming latent images internally of the grains.

The silver halide emulsion to be used in the light-sensitive silver halide color photographic material according to this invention may be prepared according to all preparation methods, including first the conventional preparation methods, as well as various other methods, such as the method as disclosed in Japanese Patent Publication No. 7772/1971 or the method as disclosed in U.S. Pat. No. 2,592,250, namely the preparation method of the so called converted emulsion, comprising forming an emulsion of silver salt grains comprising at least a part of silver salts greater in solubility than silver bromide and then converting at least a part of these grains into silver bromide or silver iodide, or the preparation method of the Lipman emulsion comprising minute particulate silver halide of 0.1 μ or less.

The above silver halide emulsion may be chemically sensitized with a chemical sensitizer. Chemical sensitizers may be classified broadly into the four kinds of noble metal sensitizers, sulfur sensitizers, selenium sensitizers and reducing sensitizers.

Noble metal sensitizers may include gold compounds or compounds or ruthenium, rhodium, palladium, iridium and platinum. Particularly preferred compounds are chloroauric acid, potassium chloroaurate, potassium aurithiocynate, potassium chloroaurate, 2-auro-sulfobenzothiazolemethyl chloride, ammonium chloropalladate, potassium chloroplatinate, sodium chloropalladite and sodium chloroiridate and the like. When a gold compound is used, ammonium thiocyanate or sodium thiocyanate may be used in combination. Sulfur sensitizers may include, in addition to active gelatin, sulfur compounds, particularly preferably sodium thiosulfate, ammonium thiosulfate, thiourea, thioacetamide, allyl isothiourea, N-arylrhodanine, etc.

Selenium sensitizers may include acrive and inactive selenium compounds. Particularly preferable compounds are colloidal selenium, selenoacetophenone, selenoacetamide, selenourea, N,N-dimethylselenourea, triphenylphoshine selenide. As the reducing sensitizers, there are monovalent tin salts, polyamine, bisalkylaminosulfide, silane compounds, iminoaminomethanesulfinic acid, hydrazinium salts, hydrazine derivatives, etc.

Further, if necessary, the silver halide emulsion can be subjected to color intensifying sensitization of spectral sensitization with the use of cyanine dyes such as cyanine, melocyanine, carbocyanine and the like or with the use of a combination of said dyes with styryl dyes.

Any desired choice of such materials can be made depending on the purpose and the use of the light-sensitive silver halide photographic material such as the wavelength region to be sensitized, sensitivity, etc.

In the above silver halide emulsion, for the purpose of preventing lowering of sensitivity and generation of fog during the manufacturing steps, storage or processing of the light-sensitive silver halide color photographic material, there may also be added various compounds such as a heterocyclic compound (e.g. 1-phenyl-5-mercaptotetrazole, 3-methylbenzothiazole, 4-hydroxy-6-methyl-1,3,3*a*,7-tetrazaindene), a mercapto compound, a metallic salt, etc.

Film hardening treatment of the emulsion may be practiced according to conventional methods. Useful film hardeners may include conventional film hardeners for photography, including aldehyde type compounds such as formaldehyde, glyoxal, glutaraldehyde or derivatives thereof such as acetal or sodium bisulfite adducts, methansulfonic acid ester type compounds, mucochloro acid or mucohalogenic acid type compounds, epoxy type compounds, aziridine type compounds, active halogen type compounds, maleic acid imide type compounds, active vinyl type compounds, carbonimide type compounds, isooxazole type compounds, N-methylol type compounds, isocyanate type compounds or inorganic film hardeners such as chromium alum, zirconium sulfate and the like.

In the above silver halide emulsion, a surfactant may be added either singly or as a mixture. As the surfactant, there may be employed various active agents such as coating aids, emulsifiers, permeability enhancers for treating solutions, defoaming agents, antistatic agents, adhesion resistant agents, or various surfactants for improvement of photographic characteristics or physical properties, including natural products such as saponin, alkylene oxide type, glycerine type or glycidol type nonionic surfactants, higher alkyl amines, heterocyclic compounds such as pyridine, quaternary nitrogen onium salts, cationic surfactants such as phosphoniums or sulfoniums, anionic surfactants containing acidic groups such as carboxylic acid, sulfonic acid phosphoric acid sulfuric acid ester groups, phosphoric acid ester groups, amphoteric surfactants such as amino acids, amino sulfonic acids, etc.

In the light-sensitive silver halide color photographic material according to this invention, there may also be incorporated in its constituent layer (e.g. protective layer, intermediate layer, emulsion layer, backing layer, etc.) a UV-absorber such as benzotriazoles, triazines or benzophenone type compounds or acrylonitrile type compounds. In particular, Tinuvin Ps, 320, 326, 327 and 328 available from Ciba-Geigy Co. may preferably be used either singly or in combination.

Further, for the purpose of increasing stability of the color photography, it is also possible to incorporate a p-substituted phenol in the emulsion layers and/or the non-light-sensitive hydrophilic colloidal layer contiguous thereto in the light-sensitive silver halide color photographic material according to this invention. As the particularly preferable p-substituted phenols, there may be included alkyl-substituted hydroquinones, bishydroquinones, polymer type hydroquinones, p-alkoxyphenols, phenolic compounds and so on. Further, alkoxy or amyloxy derivatives or 6-chromanol or 6,6'-dihydroxy-2,2'-spirochroman may also be used.

The light-sensitive silver halide color photographic material according to this invention may be prepared by applying coating on a support which is good in flatness and small in dimensional change during the manufacturing steps and processing. As such a support, there are films of cellulose acetate, cellulose nitrate, polyvinyl acetal, polypropylene, polethyleneterephthlate, polyamide, polycarbonate, polystyrene or polyethylene laminated papers, polypropylene synthetic papers, baryta papers and the like, and these supports may suitably be selected depending on the intended use of the respective light-sensitive silver halide color photographic materials.

These supports are generally applied with subbing treatments for reinforcement of adhesion to the silver halide emulsion layer. Typical subbing materials to be used in the subbing treatment may include copolymers of vinyl chloride or vinylidene chloride, copolymers of esters of vinyl alcohol, copolymers containing unsaturated carboxylic acid, copolymers of dienes such as butadiene, copolymers of acetals, copolymers of unsaturated carboxylic acid anhydrides such as maleic anhydride, especially vinyl alcohol esters such as vinyl acetate, or copolymers with styrene or ring-opened products thereof with water, an alkali, alcohols or amines, and further celullose derivatives such as nitrocellulose, diacetylcellulose, etc., compounds containing epoxy groups, gelatin or modified gelatin, polyolefinic copolymers, and so on. Further, subbing treatment may also be applied by using gelatin or polyols, monovalent or polyvalent phenols and halo-subsituted products thereof, crosslinking agents (film hardeners), metallic compounds in combination with these subbing materials.

When practically applying a subbing treatment on a support, the aforesaid subbing material may be used either singly or in combination. These subbing treatments may be performed so as to provide a subbing layer cstituted of a uni-layer or a multi-layer, but of course further over-layer may be provided by use of a subbing material in combination. For example, there may be practiced a method in which a gelatin layer is over-layed on a vinylidene copolymer layer or a method in which a layer comprising a vinylidene chloride copolymer, a mixture of copolymer of gelatin and a vinylidene chloride copolymer and a gelatin layer are sequentially coated.

Other than the subbing treatment as described above with the use of subbing materials, improvement of adhesion between the support and the emulsion layer may be effected by applying treatments such as corona discharging, glow discharging or otherwise electronic impact flame treatment, UV-ray irradiation, oxidation treatment, saponification treatment, surface roughening treatment and others. These treatments may be applied either singly or in combination, and more efficient subbing treatment may be applied by using in combination the subbing treatment with the aforesaid subbing materials.

The light-sensitive silver halide color photographic material according to this invention is inclusive of all kinds of light-sensitive silver halide color photographic materials such as color negative films, color positive films, color reversal films, color papers and the like.

The color developing agent to be used in this invention is an aromatic primary amine compound, particularly preferably a p-phenylenediamine type developing agent, as exemplified by 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethyl-4-amino-N,N-diethyl-aniline, 3-β-methanesulfonamidoethyl-4-amino-N,N-diethylaniline, 3-methoxy-4-amino-N-ethyl-N-β-methoxyethylaniline, 3-acetamide-4-amino-N,N-diethyl-aniline, 4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-amino-aniline, salts thereof such as sulfates, hydrochlorides, sulfites, p-toluensulfonic acid salts, etc.

Also, as additives for photography to be used in these color developing solutions, there may be included alkali agents (e.g. hydroxides, carbonates, phosphates of alkali metals or ammonium), pH controllers or buffering agents (e.g. weak acids such as acetic acid, boric acid or weak bases or salts thereof), development accelerators (e.g. pyridinium compounds, cationic compounds, potassium nitrate, sodium nitrate, nonionic compounds such as polyethyleneglycol condensates or derivatives thereof, polymeric compounds having sulfite ester, and, in addition, pyridine, ethanolamines, organic amines, benzyl alcohol, hydrazines and so on), fog inhibitors (e.g. including first alkali bromides, alkali iodides or nitrobenzoimidazoles, mercaptobenzoimidazole, 5-methyl- benzotriazole, 1-phenyl-5-mercaptotetrazole, compounds for rapid processing solutions, nitrobenzoic acid, benzothiazolium derivatives, phenazine-N-oxides), stain or sludge preventives, over-layer effect promoters, preservatives (e.g. sulfites, acidic sulfites, hydroxylamine hydrochloride, formsulfite, alkanolamine sulfite, etc.).

The photographic emulsion after color development is generally subjected to bleaching processing. The bleaching processing may be performed simultaneously with or separately from the fixing processing. As the bleaching agent, there may be employed compounds of polyvalent metals such as iron (III), cobalt (IV), chromium (VI) and copper (II), peracids, quinones, nitroso compounds and others. For example, there may be employed ferricyanates, bichromates, organic complex salts of iron (III) or cobalt (III), such as complex salts of organic acids, including aminopolycarboxylic acids such as ethylenediaminetetraacetic acid, nitrilotriacetic acid, 1,5-diamino-2-propanoltetracetic acid, citric acid, tartaric acid, malic acid, etc., persulfates, permanganates, nitrosophenol and so on. Among them, potassium ferricyanate, sodium iron (III) ethylenediaminetetraacetate and ammonium iron (III) ethylenediaminetetraacetate are particularly useful. The complex salt of iron (III) ethylenediaminetetraacetate is useful both in an independent bleaching solution or in a one bath bleach-fixing solution.

In a bleaching or bleach-fixing solution, there may also be added various additives such as bleaching accelerators as disclosed in U.S. Pat. Nos. 3,042,520; 3,241,966; Japanese Patent Publication Nos. 8506/1970 and 8836/1970 and thiol compounds as disclosed in Japanese Provisional Patent Publication No. 65732/1978.

This invention is illustrated in more detail by referring to the following examples, by which this invention is not limited at all.

EXAMPLE 1

On supports comprising a transparent polyethyleneterephthalate, there were provided respective layers shown below consecutively from the side of the support to prepare multi-layer color nega light-sensitive materials [Sample Nos. 1–23].

First layer: Halation preventive layer

An aqueous gelatin solution containing black colloidal silver was coated to 0.3 g of silver/m$^2$.

Second layer: Interemediate layer

An aqueous gelatin solution was coated to a dried flim thickness of 1.0$\mu$.

Third layer: Low sensitivity red sensitive silver halide elmusion layer

A silver iodobromide emulsion (prepared by mixing a silver iodobromide emulsion with a mean grain size of 0.6$\mu$ containing 4 mol % of silver iodide and a silver iodobromide with a mean grain size of 0.3$\mu$ containing 4 mol % of silver iodide at a ratio of 2:1) was chemically sensitized with gold and sulfur sensitizers, and further mixed with, as red sensitive sensitizing dyes, anhydrous 9-ethyl-3,3'-di-(3-sulfopropyl)-4,5,4'5', -dibenzothiacarbocyanine hydroxide; anhydrous 5,5-dichloro-9-ethyl-3,3'-di(3sulfobutyl) thiacarbocyanine hydroxide; and anhydrous 2-[2-{(5-chloro-3-ethyl-2(3H) -benzothiaolildene)methyl}-1butenyl]-5-chloro-3-(4-sulfobutyl) benzooxazolium, followed by addition of 1.0 g of 4-hydroxy-6-methyl-1,3,3*a*, 7-tetrazaindene and 20.0 ml of 1-phenyl-5-mercaptotetrazole to prepare a low sensitivity red sensitive emulsion. Further, per mol of silver halide, 59 g of the cyan couplers as indicated in Table 1 and 0.50 g of dodecyl gallate were added and dissolved under heating in a mixture of 65 g of dibutyl phthalate and 136 ml of ethyl acetate, and the resultant solution added into 550 ml of a 7.5% aqueous gelatin solution containing 5 g of sodium triisopropylnaphthalene sulfonate, followed by emulsification in a colloid mill. The resultant dispersion was added to the above emulsion to prepared a low sensitivity red sensitive emulsion and coated to a dried film thickness of in amounts of silver coated as indicated in Table 1 (containing 160 g of gelatin per mole of silver halide).

Fourth layer: High sensitivity red sensitive silver halide emulsion layer

A silver iodobromide emulsion (mean grain size of 1.2$\mu$, containing 7 mol % of silver iodide) was chemically sensitized with gold and sulfur sensitizers, and further mixed with, as red sensitive sensitizing dyes, anhydrous 9-ethyl-3,3'-di-)3-sulfopropyl)-4,5,4',5', -dibenzothiacarbocyanine hydroxide; anhydrous 5,5'-dichloro-9-ethyl-3,3'-di)3-sulfobutyl) thiacarbocyanine hydroxide; and anhydrous 2-[2-{(5-chloro-3-ethyl-2(3H) -benzothizolildene)methyl}-1-butenyl]-5-chloro-3-(4-sulfobutyl benzooxazolium, followed by addition of 1.0 g of 4-hydroxy-6-methyl-1,3,3*a*,7-tetrazaindene and 10.0g of 1-phenyl-5-mercaptotetrazole to prepare a high sensitivity red sensitive emulsion. Further, per mol of silver halide, 17 g of the cyan couplers as indicated in Table 1 and 0.5 g of dodecyl gallate were added and dissolved under heating in a mixture of 20 g of dibutyl phthalate and 60 ml of ethyl acetate, and the resultant solution added into 30 ml of a 7.5% aqueous gelatin solution containing 1.5 g of sodium triisopropylnaphthalene sulfonate, followed by emulsification in a colloid mill. The resultant dispersion was added to the above emulsion to prepare a low sensitivity red sensitive emulsion and coated in amounts of silver coated as indicaed in Table 1 (containing 160 g of gelatin per mol of silver halide).

Fifth layer: Intermediate layer

The same as the second layer.

Sixth layer: Low sensitivity green sensitive silver halide emulsion layer

A silver iodobromide emulsion with a mean grain size of 0.6 $\mu$ containing 4 mol % of silver iodide and a silver iodobromide emulsion with a mean grain size of 0.3$\mu$ containing 7 mol % of silver iodide were each chemically sensitized with gold and sulfur sensitizers, and further mixed with, as green sensitive sensitizing dyes, anhydrous 5,5'-dichloro-9-ethyl-3,3'-di(3- sulfobutyl-)oxacarbocyanine hydroxide; anhydrous 5,5'-diphenyl-9-ethyl-3,3-di-(sulfobutyl)oxacarboxyanine hydroxide; and anhydrous 9-ethyl-3,3-di(3-sulfopropyl)- 5,6,5',6'-dibenzooxacarbocyanine hydroxide, followed by addition of 1.0 g of 4-hydroxy-6-methyl-1,3,3*a*-7-tetrazaindene and 20.0 mg of 1-phenyl-5-mercaptotetrazole. The thus obtained two kinds of silver halide emulsions were mixed at a ratio of 1:1 to prepare a low sensitivity green sensitive silver halide emulsion.

Further, per mol of silver halide, there were added as a magenta coupler 100 g of 1-(2,4,6-trichlorophenyl)-3-{3-(4-dodecyloxyphenyl)sulfonamidobenzamido}-pyrazolin- 5-one, as a colored magenta coupler 2.5 g of 1-(2,4,6-trichlorophenyl)-4-(1-naphthylazo)-3-(2-chloro-5-octadecenylsuccinimidoanilino)-5-pyrazolone, 0.5 g of dodecyl gallate, and as a DIR compound 1.8 g of 2-(1-phenyl-5-tetrazolylthio)-4-octadecylsuccinimide-1- indanone and dissolved under heating in a mixture of 120 g of tricresyl phosphate and 240 ml, and the resultant solution added into an aqueous gelatin solution containing sodium triisopropylnaphthalene sulfonate, followed by emulsification in a colloid mill. The resultant dispersion was mixed with the above emulsion to prepare a low sensitivity green sensitive emulsion, which was coated in an amount of silver coated of 1.5 g/m$^2$ (containing 160 g of gelatin per mole of silver halide).

Seventh layer: High sensitivity green sensitive silver halide emulsion layer

A silver iodobromide emulsion with a mean grain size of 1.2μ containing 7 mol % of silver iodide was chemically sensitized with gold and sulfur sensitizers, and further mixed with, as green sensitive sensitizing dyes, anhydrous 5,5'-dichloro-9-ethyl-3,3'-di-(3- sulfobutyl-)oxacarbocyanine hydroxide; anhydrous 5,5'- diphenyl-9-ethyl-3,3'-di-(sulfobutyl)oxacarboxyanine hydroxide; and anhydrous 9-ethyl-3,3'-di-(3-sulfopropyl) -5,6,5',6'-dibenzooxacarbocyanine hydroxide, followed by addition of 1.0 g of 4-hydroxy-6-methyl- 1,3,3*a*-7-tetrazaindene and 10.0 mg of 1-phenyl-5- mercaptotetrazole to prepare a high sensitivity green sensitive silver halide emulsion. Further, per mol of silver halide, there were added as a magenta coupler 80 g of 1-(2,4,6-trichlorophenyl)-3-{3-(2,4-di-t-amyl- phenoxyacetamido)benzamido}-pyrazolin-5-one, as a colored magenta coupler 2.5 g of 1-(2,4,6-trichlorophenyl) -4-(1-naphthylazo)-3-(2-chloro-5-octadecenylsuccinimidoanilino) -5-pyrazolone, 1.5 g of 2,5-di-t-octylhydroquinone and as a DIR compound 1.0 g of 2-(1-phenyl-5-tetrazolylthio)-4-octadecylsuccinimide- 1indanone and dissolved under heating in a mixture of 120 g of tricresyl phosphate and 240 ml, and the resultant solution added into an aqueous gelatin solution containing sodium triisopropylnaphthalene sulfonate, followed by emulsification in a colloid mill. The resultant dispersion was mixed with the above emulsion to prepare a high sensitivity green sensitive emulsion, which was coated in an amount of silver coated of 1.8 g/m$^2$ (containing 160 g of gelatin per mole of silver halide).

Eighth layer: Intermediate layer

The same as the second layer.

Ninth layer: Yellow filterlayer

In an aqueous gelatin solution having yellow colloidal silver dispersed therein, there was added a dispersion containing a solution of 3 g of 2,5-di-t-octylhydroquinone and 1.5 of di-2-ethylhexylphthalate dissolved in 10 ml of ethyl acetate dispersed in an aqueous gelatin solution containing 0.3 g of sodium triisopropylnaphthalane sulfonate, and the resultant mixture was coated at a proportion of 0.9 g of gelatin/m$^2$ and 0.10 g of 2,5-di-t-octylhydroquinone.

Tenth layer: Low sensitivity blue sensitive silver halide emulsion layer

A silver iodobromide emulsion with a mean grain size of 0.6μ containing 6 mol % of silver iodide was chemically sensitized with gold and sulfur sensitizers, and further mixed with, as sensitizing dyes, anhydrous 5,5'-dimethoxy-3,3'-di-(3-sulfopropyl)thiacyanine hydroxide, followed by addition of 1.0 g of 4-hydroxy- 6-methyl-1,3,3*a*-7-tetrazaindene and 20.0 mg of 1-phenyl-5-mercaptotetrazole to prepare a low sensitivity blue sensitive silver halide emulsion. Further, per mol of silver halide, there were added as a yellow coupler 120 g of α-pivaloyl-α-(1-benzyl-2- phenyl-3,5-dioxo-1,2,4-triazolidine-4-yl)-2'-chloro-5'- 5'-[α-(dodecyloxycarbonyl)ethoxycarbonyl]acetanilide and 50 g of *a*-{3-[α-(2,4-di-t-amylphenoxy)butylamide)}- benzoyl-2'-methoxyacetanililde and dissolved under heating in a mixture of 120 g of dibutyl phthalate and 300 ml of ethyl acetate, and the resultant solution added into a aqueous gelatin solution containing sodium triisopropylnaphthalene sulfonate, followed by emulsification in a colloid mill. The resultant dispersion was mixed with the above emulsion to prepare a low sensitivity blue sensitive emulsion, which was coated in an amount of silver coated of 0.7 g/m$^2$ (containing 160 g of gelatin per mole of silver halide).

Eleventh layer: High sensitivity blue sensitive silver halide emulsion layer

A silver iodobromide emulsion with a mean grain size of 1.2μ containing 7 mol % of silver iodide was chemically sensitized with gold and sulfur sensitizers, and further mixed with, as sensitizing dyes, anhydrous 5,5'-dimethoxy-3,3-di-(3-sulfopropyl)thiacyanine hydroxide, followed by addition of 1.0 g of 4-hydroxy- 6-methyl-1,3,3*a*-7-tetrazaindene and 10.0 mg of 1-phenyl-5-mercaptotetrazole to prepare a high sensitivity blue sensitive silver halide emulsion. Further, per mol of silver halide, there was added as a yellow coupler 80 g of α-pivaloyl-α-(1-benzyl-2- phenyl-3,5-dioxo-1,2,4-triazolidine-4-yl)-2'-chloro-5'- 5'-[α-(dodecyloxycarbonyl)ethoxycarbonyl]acetanilide and dissolved under heating in a mixture of 80 g of dibutyl phthalate and 240 ml ethyl acetate, and the resultant solution added into an aqueous gelatin solution containing sodium triisopropylnaphthalene sulfonate, followed by emulsification in a colloid mill. The resultant dispersion was mixed with the above emulsion to prepare a high sensitivity green sensitive emulsion, which was coated in an amount of silver coated of 0.9 g/m$^2$ (containing 240 g of gelatin per mole of silver halide).

Twelfth layer: Intermediate layer

A dispersion of a mixture of 2 g of di-2-ethyl- hexylphthalate, 2 g of 2-[3-cyano-3-(n-dodecylaminocarbonyl) allylidene]-1-ethylpyrolildine and 2 ml of ethyl acetate dispersed in an aqueous gelatin solution containing 0.6 g of sodium triisopropylnaphthalene sulfonate was coated at a proportion of 1.0 g of gelatin/ m$^2$.

Thirteenth layer: Protective layer

An aqueous gelatin solution containing 4 g of gelatin and 0.2 g of 1,2-bisvinylsulfonylethane was coated at a proportion of 1.3 g of gelatin/m$^2$.

The respective samples thus obtained were subjected to wedge exposure according to the conventional method, followed by the following development processings. The results obtained for respective samples are shown in Table 2.

| [Processing] (38° C.) | Processing time |
|---|---|
| Color development | 3 minutes 15 seconds |
| Bleaching | see (*1) infra |
| Washing with water | 3 minutes 15 seconds |
| Fixing | 6 minutes 30 seconds |
| Washing with water | 3 minutes 15 seconds |
| Stabilization | 1 minute 15 seconds |

The following processing solutions were used in the processing steps:

| [Composition of color developing solution] | |
|---|---|
| 4-Amino-3-methyl-N—ethyl-N—(β-hydroxyethyl)-aniline sulfate | 4.75 g |
| Anhydrous sodium sulfite | 4.25 g |
| Hydroxylamine half-sulfate | 2.0 g |
| Anhydrous potassium carbonate | 37.5 g |
| Sodium bromide | 1.3 g |

-continued

| | |
|---|---|
| Trisodium nitrilotriacetate (monohydrate) | 2.5 g |
| Potassium hydroxide | 1.0 g |
| Made up to 1 liter with water, and adjusted to pH with potassium hydroxide. | 10.0 |
| [Composition of bleaching solution] | |
| Ferric ammonium salt of ethylenediamine-tetraacetic acid | 100.0 g |
| Diammonium salt of ethylenediamine-tetraacetic acid | 10.0 g |
| Ammonium bromide | 150.0 g |
| Glacial acetic acid | 10.0 ml |
| Made up to 1 liter with water and adjusted to pH 6.0 with aqueous ammonia | |
| [Composition of fixing solution] | |
| Ammonium thiosulfate (50% aqueous solution) | 162 ml |
| Anhydrous sodium sulfite | 12.4 g |
| Made up to 1 liter with water and adjusted to ph 6.5 with acetic acid | |
| [Composition of stabilizing solution] | |
| Formalin (37% aqueous solution) | 5.0 ml |
| Konidax (available from Konishiroku Photo Industry Co., Ltd.) | 7.5 ml |
| Made up to 1 liter with water. | |

The development processings were conducted under the above conditions.

(*1): The bleaching processing was practiced under the three conditions as shown below.

| | Bleaching processing time | Bleaching liquid potential |
|---|---|---|
| BL - 1 | 6 min. 30 sec. | 150 mV |
| BL - 2 | 4 min. 20 sec. | 150 mV |
| BL - 3 | 6 min. 30 sec. | 75 mV |

Control couplers:

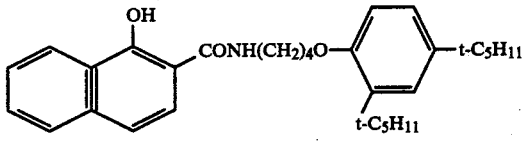

C-1

-continued

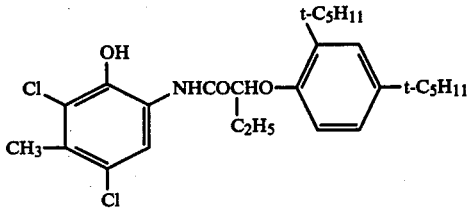

C-2

Detection of image sharpness was conducted by determining MTF (Modulation Transfer Function) and making comparison between the greatness of values at space frequencies of 10 lines/mm and 30 lines/mm.

Graininess (RMS) was also evaluated by comparison between the 1000-fold values of the standard deviations of fluctuations in density values which occur during scanning be means of a microdensitometer with a circular scanning orifice diameter off 25$\mu$ . In the Table 2, specific sensitivities and the maximum color formed densities were measured for respective samples at a residual silver content of 0 mg/m$^2$ after thorough bleaching processing, and the specific sensitivities are shown in terms of relative values to that of Sample 5 as 100 .

As apparently seen from Table 2, the results of Samples 1–9 indicate that silver removal characteristic is worsened to a great extent as the increase in silver quantity in the red sensitive layer, although improvements in sensitivity elevation and image quality can be observed. That is, in case of a color sensitive material of high sensitivity and high quality in which a cyan coupler known in the art is employed, silver removal characteristic is extremely deteriorated.

On the other hand, form the results of Samples 10 to 23 , it can clearly be seen that high sensitivity and high image quality can be accomplished and further that there is also no problem with respect to silver removal characteristic. Further, even when the bleaching time may be shortened or the potential of the bleaching solution lowered, there can be provided color sensitive materials of high sensitivity and high image quality substantially without worsening of silver removal.Thus, superiority of this invention is evident also in this respect.

TABLE 1

| Sample No. | Cyan Coupler | Total amount of silver coated | Amount of silver coated in red sensitive layer: Total | 3rd layer | 4th layer | Amount of residual silver content under various conditions (mg/m$^2$): BL-1 ordinary | BL-2 Time | BL-3 Potential | Remarks |
|---|---|---|---|---|---|---|---|---|---|
| 1 | Control C-1 | 7.4 | 2.5 | 1.0 | 1.5 | 0 mg/m$^2$ | 0 mg/m$^2$ | 0 mg/m$^2$ | Control |
| 2 | " | 8.4 | 3.5 | 1.5 | 2.0 | 0 | 0 | 0 | " |
| 3 | " | 8.9 | 4.0 | 1.7 | 2.3 | 5 | 17 | 20 | " |
| 4 | " | 9.4 | 4.5 | 2.0 | 2.5 | 34 | 61 | 70 | " |
| 5 | " | 9.9 | 5.0 | 2.2 | 2.8 | 52 | 101 | 104 | " |
| 6 | " | 10.9 | 6.0 | 2.5 | 3.5 | 70 | 121 | 125 | " |
| 7 | Control C-2 | 8.4 | 3.5 | 1.5 | 2.0 | 4 | 9 | 13 | " |
| 8 | " | 8.9 | 4.0 | 1.7 | 2.3 | 11 | 25 | 37 | " |
| 9 | " | 9.4 | 5.0 | 2.2 | 2.8 | 41 | 63 | 74 | " |
| 10 | Exemplary compound 11 | 7.4 | 2.5 | 1.0 | 1.5 | 0 | 0 | 0 | Invention |
| 11 | Exemplary compound 11 | 8.4 | 3.5 | 1.5 | 2.0 | 0 | 0 | 0 | " |
| 12 | Exemplary compound 11 | 8.9 | 4.0 | 1.7 | 2.3 | 0 | 0 | 0 | " |
| 13 | Exemplary compound 11 | 9.4 | 4.5 | 2.0 | 2.5 | 0 | 0 | 0 | " |
| 14 | Exemplary | 9.9 | 5.0 | 2.2 | 2.8 | 0 | 0 | 3 | " |

TABLE 1-continued

| Sample No. | Cyan Coupler | Total amount of silver coated | Amount of silver coated in red sensitive layer: Total | 3rd layer | 4th layer | Amount of residual silver content under various conditions (mg/m²): BL-1 ordinary | BL-2 Time | BL-3 Potential | Remarks |
|---|---|---|---|---|---|---|---|---|---|
| | compound 11 | | | | | | | | |
| 15 | Exemplary compound 11 | 10.9 | 6.0 | 2.5 | 3.5 | 0 | 2 | 5 | " |
| 16 | Exemplary compound 22 | 8.4 | 3.5 | 1.5 | 2.0 | 0 | 0 | 0 | " |
| 17 | Exemplary compound 22 | 9.4 | 4.0 | 1.7 | 2.3 | 0 | 0 | 0 | " |
| 18 | Exemplary compound 22 | 9.9 | 5.0 | 2.2 | 2.8 | 0 | 0 | 3 | " |
| 19 | Exemplary compound 22 | 10.9 | 6.0 | 2.5 | 3.5 | 0 | 5 | 9 | " |
| 20 | Exemplary compound 37 | 8.4 | 3.5 | 1.5 | 2.0 | 0 | 0 | 0 | " |
| 21 | Exemplary compound 37 | 9.4 | 4.0 | 1.7 | 2.3 | 0 | 0 | 0 | " |
| 22 | Exemplary compound 37 | 9.9 | 5.0 | 2.2 | 2.8 | 0 | 0 | 3 | " |
| 23 | Exemplary compound 37 | 10.9 | 6.0 | 2.5 | 3.5 | 0 | 5 | 10 | " |

TABLE 2

| Sample No. | Cyan Coupler | Photographic characteristics in red sensitive layer: Specific sensitivity | Maximum color formed density | Color image quality: MTF 10 lines/mm | MTF 30 lines/mm | RMS | Remarks |
|---|---|---|---|---|---|---|---|
| 1 | Control C-1 | 61 | 1.10 | 87 | 58 | 99 | Control |
| 2 | " | 75 | 1.40 | 97 | 69 | 90 | " |
| 3 | " | 81 | 1.58 | 102 | 79 | 84 | " |
| 4 | " | 92 | 1.93 | 118 | 84 | 75 | " |
| 5 | " | 100 | 2.00 | 134 | 90 | 68 | " |
| 6 | " | 120 | 2.04 | 130 | 87 | 59 | " |
| 7 | Control C-2 | 101 | 1.37 | 92 | 68 | 93 | " |
| 8 | " | 115 | 1.55 | 100 | 78 | 86 | " |
| 9 | " | 125 | 1.90 | 123 | 86 | 71 | " |
| 10 | Exemplary compound 11 | 75 | 1.23 | 116 | 88 | 75 | Invention |
| 11 | Exemplary compound 11 | 98 | 1.63 | 137 | 91 | 67 | " |
| 12 | Exemplary compound 11 | 112 | 1.82 | 140 | 93 | 63 | " |
| 13 | Exemplary compound 11 | 123 | 1.93 | 145 | 97 | 60 | " |
| 14 | Exemplary compound 11 | 138 | 2.03 | 143 | 96 | 53 | " |
| 15 | Exemplary compound 11 | 153 | 2.10 | 142 | 96 | 49 | " |
| 16 | Exemplary compound 22 | 95 | 1.70 | 138 | 92 | 68 | " |
| 17 | Exemplary compound 22 | 125 | 1.94 | 143 | 96 | 61 | " |
| 18 | Exemplary compound 22 | 140 | 2.03 | 145 | 97 | 55 | " |
| 19 | Exemplary compound 22 | 155 | 2.09 | 140 | 94 | 51 | " |
| 20 | Exemplary compound 37 | 94 | 1.68 | 134 | 91 | 70 | " |
| 21 | Exemplary compound 37 | 124 | 1.91 | 145 | 98 | 64 | " |
| 22 | Exemplary compound 37 | 136 | 2.00 | 141 | 96 | 60 | " |
| 23 | Exemplary compound 37 | 160 | 2.11 | 139 | 93 | 55 | " |

We claim:

1. A light-sensitive silver halide color photographic material, having a blue sensitive silver halide emulsion layer, a green sensitive silver halide emulsion and a red sensitive silver halide emulsion on a support, wherein said red sensitive silver halide emulsion contains at least one compound of formula wherein the amount of silver halide contained in all of the aforesaid light-sensitive silver halide emulsion layers is at least 7.5 g/m² as calculated on silver, and the amount of the silver halide contained in said red sensitive silver halide emulsion is at least 3.5 g/m² as calculated on silver:

Formula [I]

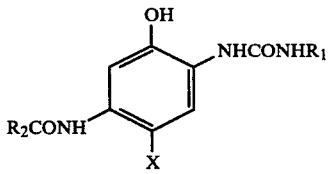

wherein, X represents a hydrogen atom or a group capable of being eliminated by a coupling reaction with an oxidized product of an aromatic primary amine color developing agent; $R_1$ represents a naphthyl group or a heterocyclic group (provided that a carbon atom of said heterocyclic group is bonded to the ureido group), or a phenyl group having at least one substituent (with the proviso that when one of said substituents is cyano at the p-position of said phenyl group relative to the ureido group, the four ortho and meta positions of said phenyl group relative to the ureido group cannot have hydrogen atoms at the same time) selected from the group consisting of a trifluoromethyl, nitro, cyano, —COR, —COOR, $—SO_2R$, $—SO_2OR$,

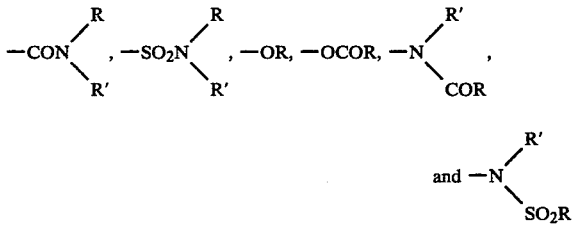

(wherein R represents an aliphatic group or an aromatic group, and R′ is a hydrogen atom, an aliphatic group or an aromatic group); and $R_2$ represents an aliphatic group or an aromatic group necessary to impart diffusion resistance to the cyan dyes formed from the cyan couplers represented by formula and the cyan dyes to be formed from said cyan coupler.

2. The light-sensitive silver halide color photographic material according to claim 1, wherein said cyan coupler represented by formula is a compound of formula Formula [Ia]

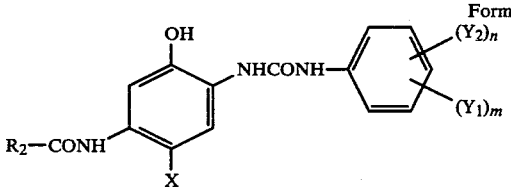

Formula [Ib]

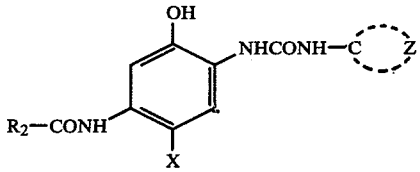

wherein, $Y_1$ is selected from the group consisting of trifluoromethyl, nitro, cyano, —COR, —COOR, $—SO_2R$, $—SO_2OR$,

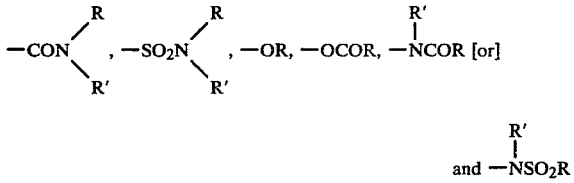

(wherein R represents an aliphatic group or an aromatic group, and R′ represents a hydrogen atom or a group represented by R); $Y_2$ is selected from the group consisting of a monovalent group, an aromatic group, a halogen atom, an amino group, a hydroxy group and a substituent represented by $Y_1$; m is an integer of 1 to 3, and n is an integer of 0 to 3, with the proviso that m+n is 5 or less and when a cyano group is bonded at the p-position of the ureido group then m+n is within the range of from 2 to 5; and Z represents a group of non-metallic atoms necessary for forming a heterocyclic group or a naphthyl group, said heterocyclic group being a five-membered or six-membered heterocyclic group containing 1 to 4 hetero atoms selected from the group consisting of nitrogen atoms, oxygen atoms and sulfur atoms.

3. The light-sensitive silver halide color photographic material according to claim 2, wherein the aliphatic group represented by R is an alkyl group having 1 to 10 carbon atoms and the aromatic group represented by R is a phenyl group; and the monovalent group represented by $Y_2$ is an aliphatic group, and the aromatic group represented by $Y_2$ is a phenyl group or a naphthyl group.

4. The light-sensitive silver halide color photographic material according to claim 3, wherein the aliphatic group represented by $Y_2$ is an alkyl group having 1 to 10 carbon atoms.

5. The light-sensitive silver halide color photographic material according to claim 2, wherein said heterocyclic group represented by Z is selected from the group consisting of a furyl group, a thienyl group, a pyridyl group, a quinonyl group, an oxazolyl group, a tetrazolyl group, a benzothiazolyl group and a tetrahydrofuranyl group.

6. The light-sensitive silver halide color photographic material according to claim 5, wherein said heterocyclic group represented by Z has at least one substituent selected from the group consisting of alkyl groups having 1 to 10 carbon atoms, aryl groups, halogen atoms, cyano, nitro, sulfonamide groups, sulfamoyl groups, sulfonyl groups, fluorosulfonyl groups, carbamoyl groups, oxycarbonyl groups, acyl groups, heterocyclic groups, alkoxy groups, aryloxy groups and acloxy groups.

7. The light-sensitive silver halide color photographic material according to claim 1, wherein said aliphatic group or aromatic group represented by $R_2$ is selected from the group consisting of an alkyl group having 4 to 30 carbon atoms, an alkenyl group, a cycloalkyl group, a five-membered or six-membered heterocyclic group and a group represented by formula:

Formula [Ic]

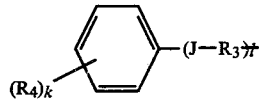

wherein J represents an oxygen atom or a sulfur atom; K represents an integer of 0 to 4; 1 represents an integer of 0 or 1; wherein when K is at least 2, the groups represented by $R_4$ may be the same or different; $R_3$ represents a straight or branched alkyl group having 1 to 20 carbon atoms; and $R_4$ represents a monovalent atom or a monovalent group.

8. The light-sensitive silver halide color photographic material according to claim 1, wherein the amount of the silver halide contained in all of the aforesaid light-sensitive silver halide emulsion layers is 7.5 to 15 g/m$^2$ as calculated on silver.

9. The light-sensitive silver halide color photographic material according to claim 1, wherein the amount of the silver halide contained in said red sensitive silver halide emulsion is 3.5 to 10 g/m$^2$ as calculated on silver.

10. The light-sensitive silver halide color photographic material according to claim 1, wherein the proportion of the amount of silver halide in the red sensitive silver halide emulsion is 40 to 80%.

* * * * *